US006142080A

United States Patent [19]

Ziemba

[11] Patent Number: 6,142,080

[45] Date of Patent: Nov. 7, 2000

[54] SPIN-DECAY SELF-DESTRUCT FUZE

[75] Inventor: Richard T. Ziemba, Burlington, Vt.

[73] Assignee: General Dynamics Armament Systems, Inc., Falls Church, Va.

[21] Appl. No.: 09/097,382

[22] Filed: Jun. 16, 1998

Related U.S. Application Data

[60] Provisional application No. 60/071,464, Jan. 14, 1998, and provisional application No. 60/071,467, Jan. 14, 1998.

[51] Int. Cl.[7] ..... F42C 9/18

[52] U.S. Cl. ..... 102/267; 102/500; 102/206

[58] Field of Search ..... 102/499, 500, 102/237, 238, 231, 232, 257, 264, 266, 267, 265, 206

[56] References Cited

U.S. PATENT DOCUMENTS

| | | | |
|---|---|---|---|
| 3,167,014 | 1/1965 | Kopito | 102/206 |
| 3,353,486 | 11/1967 | Haiken . | |
| 3,397,640 | 8/1968 | Ziemba et al. . | |
| 3,504,632 | 4/1970 | West . | |
| 3,595,169 | 7/1971 | Ziemba . | |
| 3,610,153 | 10/1971 | Betts . | |
| 3,670,652 | 6/1972 | Ziemba . | |
| 3,714,898 | 2/1973 | Ziemba . | |
| 3,818,835 | 6/1974 | Valatka | 102/70.2 |
| 3,844,217 | 10/1974 | Ziemba . | |
| 3,983,819 | 10/1976 | Fairbanks | 102/70.2 |
| 4,026,215 | 5/1977 | Ziemba et al. . | |
| 4,044,680 | 8/1977 | Ziemba . | |
| 4,050,382 | 9/1977 | Power | 102/16 |
| 4,242,963 | 1/1981 | Ziemba . | |
| 4,494,459 | 1/1985 | Ziemba . | |
| 5,243,912 | 9/1993 | Ziemba . | |
| 5,343,795 | 9/1994 | Ziemba . | |

*Primary Examiner*—Jack W Lavinder
*Attorney, Agent, or Firm*—Finnegan, Henderson, Farabow, Garrett & Dunner

[57] ABSTRACT

Apparatus mountable in a projectile for utilization with a rotor-type safing and arming mechanism for post-launch self-neutralization of a spinning projectile having a fused warhead and a stab detonator, including a launch-activated battery, an electric detonator positioned sufficiently close to the stab detonator to initiate the stab detonator upon initiation of the electric detonator, and a spin decay switch circuit operatively interconnecting a charged storage capacitor and the electric detonator upon substantial cessation of projectile spin, for delivering power sufficient to initiate the electric detonator. The apparatus includes a storage capacitor charging circuit activated by launch-induced forces. The apparatus further includes a pre-launch shorting circuit electrically connected in parallel with the electric detonator and deactivated by launch forces, and a "bleed" circuit connected in parallel with the battery activated by launch-induced forces.

29 Claims, 15 Drawing Sheets

PRE LAUNCH

FLIGHT

TARGET IMPACT

SPIN-DECAY SELF-DESTRUCT FUZE

This application claims priority to Provisional Applications 60/071,464 and 60/071,467 both filed Jan. 14, 1998, the disclosures of which are hereby incorporated by reference.

A related application of the same inventor, S.N. (not yet assigned), is being filed concurrently herewith and entitled "RC Time Delay Self-Destruct Fuze".

BACKGROUND OF THE INVENTION

1. Field of the Invention

This invention relates to self-destruct and self-neutralization mechanisms for explosive ordnance and to improved safing devices for impact-initiated explosive ordnance to include self-destruct and self-neutralization mechanisms.

2. Prior Art

The U.S. Military is increasingly demanding that, where practical, all new explosive ordnance devices being developed incorporate a fuzing system for neutralizing or otherwise self-destroying such munitions once they have completed their intended mission, and that this self-neutralization feature is to be implemented using components which are independent of the primary initiating mechanism within the fuse.

The primary safety device of conventional fuzes is an out-of-balance rotor assembly which contains a stab-sensitive detonator. The rotor is retained in its "safe" position (detonator out-of-line with a firing pin and explosive booster) by means of a setback-activated release pin and/or a spin-activated rotor lock. At projectile firing, setback and spin forces, respectively the longitudinally and radially directed inertial forces with respect to the projectile spin axis, release the rotor thereby allowing it to rotate into its "armed" position thereby translating the detonator into alignment with the firing pin and booster. At target impact, the rotor (with its detonator) is thrust forward into a fixed position firing pin to cause the detonator to function and the warhead to explode.

One deficiency of this conventional fuse is that with a low velocity target impact against soft targets (snow bank for example) there may be insufficient impact energy for the fuze to function properly. In that case, the round may be left fully armed and possibly with the firing pin partially imbedded into the detonator. This is a potentially dangerous situation if someone disturbs the round under these conditions. Thus, a self neutralization feature incorporated into the fuze which would cause the round to detonate or otherwise be incapacitated following impact if target impact forces were insufficient to cause normal functioning of the fuze, would be highly desirable.

SUMMARY OF THE INVENTION

In accordance with the invention as embodied and broadly described herein, the apparatus for post-launch self-neutralization of a projectile having a fused warhead including a stab detonator and a launch-induced spin, comprises an electric power source; an electric detonator positioned sufficiently close to the stab detonator to initiate the stab detonator upon initiation of the electric detonator; and a spin decay switch circuit operatively connected to both the power source and the electric detonator for activating the electric detonator upon substantial decay of the projectile spin. Each of the power source, the spin decay switch circuit, and the electric detonator are configured for mounting in the projectile.

The spin decay switch circuit includes an energy storage capacitor, and a spin decay switch having a first position under the influence of launch-induced spin forces, and a second position under the substantial absence of launch-induced spin forces. The spin decay switch in the first position interconnects the energy storage capacitor to be charged by the power source, preferably through a delay resistor, and in the second position interconnects the energy storage capacitor to be discharged through the electric detonator. The spin decay switch can include a cantilevered spring contact element having a free end movable between the first and second positions.

It is also preferred that the apparatus include a shorting circuit electrically connected in parallel with the electric detonator, and activatable from a conducting state for times prior to launch, to a non-conducting state for times following launch, such as by a launch-induced setback force-activated switch having a conducting element and a movable weight element disposed to shear the conducting element when acted upon by launch-induced setback forces.

It is further preferred that the electric power source includes a launch-activatable reserve battery and the apparatus further includes a power source dissipation circuit including a bleed resistor electrically connected in parallel with the power source.

It is still further preferred that where the projectile has a spin-activated safing and arming mechanism including a housing and a rotor pivotally mounted therein and the stab detonator is mounted on the rotor element, each of the electric power source and the spin decay switch circuit are configured for mounting on the rotor or the housing.

Further in accordance with the present invention as embodied and broadly described herein, the method for post-launch self-neutralizing a projectile having a fused warhead including a stab detonator and a launch-induced spin includes the steps of providing in the projectile an electric power source, an electric power storage device, and an electric detonator, the providing step including the substep of locating the electric detonator sufficiently close to the stab detonator to initiate the stab detonator upon the initiation of the electric detonator; supplying power to the electric power storage device from the electric power source after launch; and applying power from the electric power storage device to the electric detonator upon substantial decay of the projectile spin to initiate the electric detonator.

Preferably, the method includes the initial step of providing an energy storage capacitor, and the applying power step further includes the substeps of operatively interconnecting the electric power source to charge the energy storage capacitor using launch-induced spin forces, and subsequently operatively interconnecting the charged energy storage capacitor to discharge through the electric detonator after substantial decay of the launch-induced spin forces.

It is also preferred that the method further include the step of deactivating the electric power source a predetermined time after activation such as by dissipating the power in the electric power source, and the step of providing a shorting circuit for the electric detonator for times prior to launch and deactivating the shorting circuit for times subsequent to launch.

BRIEF DESCRIPTION OF THE DRAWINGS

A better understanding of the present invention will be had upon reference to the detailed description when read in conjunction with the accompanying drawing in which:

FIGS. 3A, 3B and 3C are schematic representations of self-neutralizing apparatus made in accordance with a first embodiment of the present invention wherein FIG. 3A depicts prelaunch conditions, FIG. 3B depicts flight conditions, and FIG. 3C depicts target impact conditions of the apparatus;

FIG. 5A depicts the prelaunch condition, FIG. 5B the flight condition, and FIG. 5C the post-impact condition of the apparatus;

Reference will now be made to the present preferred embodiments of the invention which are illustrated in the accompanying drawings.

DESCRIPTION OF THE PREFERRED EMBODIMENTS

Figure 1:
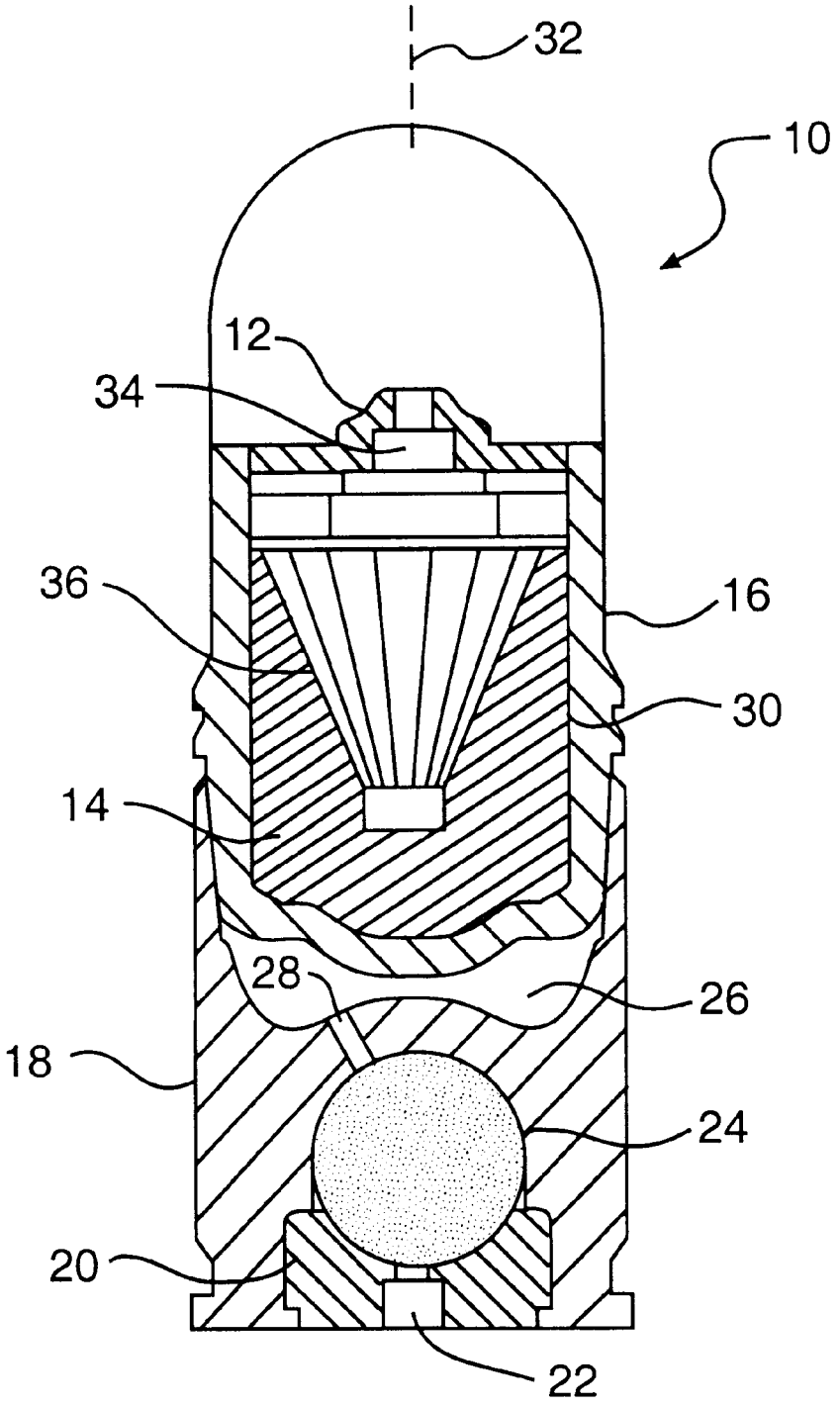
FIG. 1 PRIOR ART
FIG. 1 is a sectional schematic view of an M430 rifle-launch grenade, a conventional impact initiated explosive round.

FIG. 1 is a cross-sectional view of a typical, gun-launched projectile that can advantageously incorporate the present invention, as will be explained in detail hereinafter. Specifically, FIG. 1 shows an M430 grenade round 10 before any modifications are made to incorporate the present invention. Round 10 incorporates a point-initiating, base-detonating ("PIBD") M549 fuze 12, a shaped charge warhead 14 and an anti-personnel fragmenting projectile body 16.

Round 10 also conventionally includes cartridge case 18 incorporating base plug 20 and percussion primer 22 designed to ignite propelling charge 24. Hot gases from ignited propelling charge 24 flow into low pressure chamber 26 via vent 28 to expel projectile body 16 from case 18. Round 10 also conventionally is used with a rifled gun barrel (not shown) and therefore incorporates one or more bands 30 to engage the barrel rifling to impart a spin to projectile body 16 about axis 32. Shaped charge 14 can be initiated by "spit back" booster charge 34, which is activated by PIBD fuze 12, in a manner to be described henceforth, and can have copper liner 36 to increase explosive efficiency, as is well known.

PIBD fuze 12, shown in more detail in FIG. 2 again in an unmodified state, contains a mechanical safing and arming ("S&A") device generally designated by the numeral 38 which controls the operation of an out-of-line explosive train by the action of projectile setback and spin forces. More specifically, S&A device 38 includes stationary firing pin 40 mounted on housing cap 42 coincident with projectile axis 32. S&A device 38 further includes rotor 44 including rotor weight 45 mounted for pivoting movement axis 50 is spaced from, but parallel to, projectile axis 32. Rotor weight 45 has a mass distribution that is non-symmetrical with respect to the pivot 50 such that launch-induced spin forces will tend to rotate rotor 44 about pivot axis 50.

Figure 2:
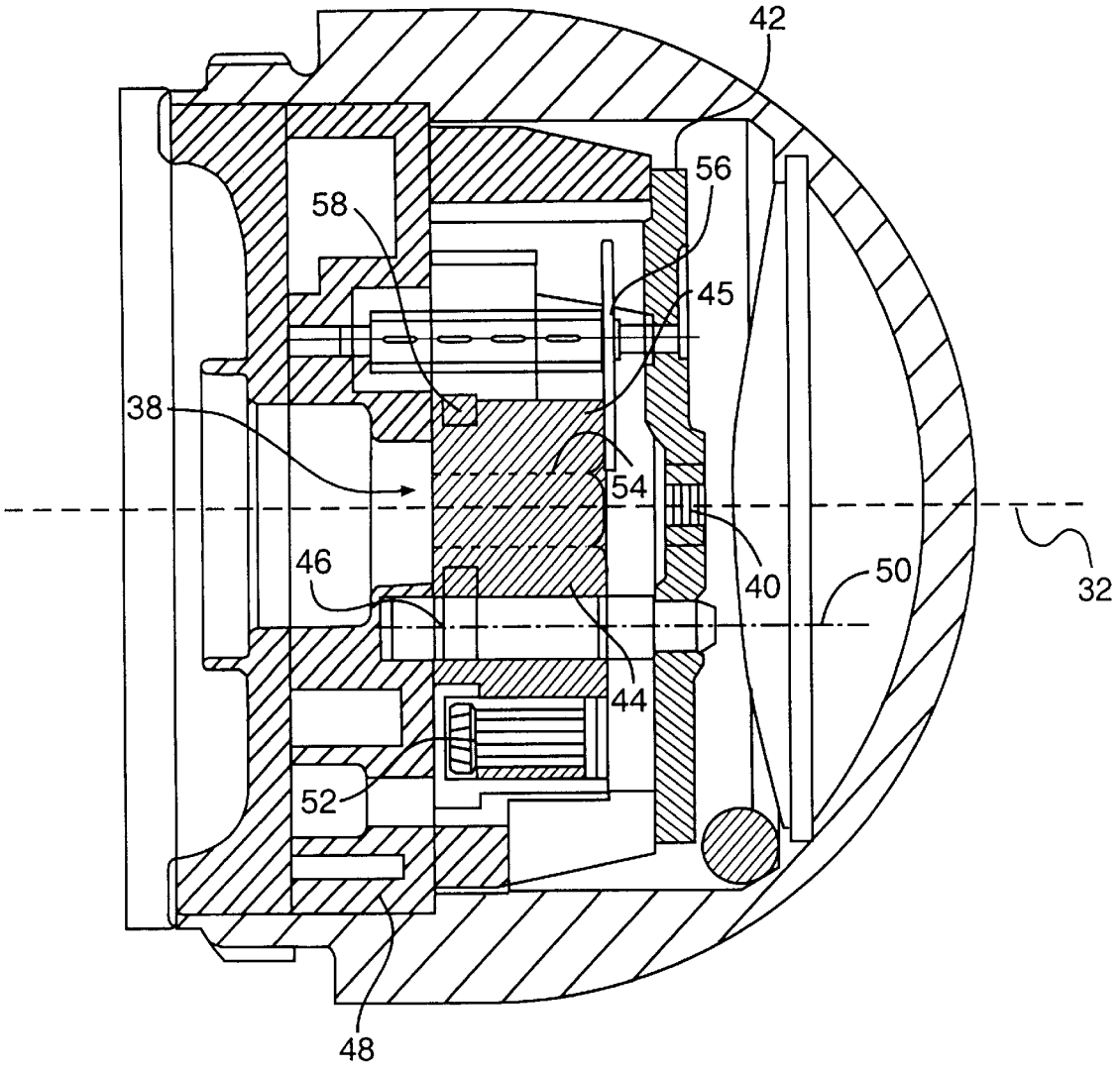
FIG. 2 PRIOR ART
FIG. 2 is a sectional schematic view of a detail from FIG. 1 showing components of an S&A device.

Stab detonator 52 is mounted in rotor weight 45 spaced from pivot axis 50 by an amount similar to the spacing between pivot axis 50 and projectile axis 32 such that upon pivoting movement of rotor 44, stab detonator 52 moves from a position "out-of-line" with firing pin 40 (as shown in FIG. 2) to an "in-line" position shown dotted in FIG. 2 at 54. S&A device 38 includes escapement device 56 which engages the teeth of sector gear 58 which is part of rotor 44 to control the pivoting rate of rotor 44 about pivot axis 50. When rotor weight 45 is acted on by launch-induced spin forces, escapement device 56 limits the pivot rate such that stab detonator 52 does not reach the "in-line" position until after the projectile reached a safe distance from the gun. S&A device 38 also includes a safety setback pin and a spin-deactivated rotor lock, both not shown. These safety devices are overridden at launch by the launch-induced setback and spin forces, allowing rotor 44 to pivot under the control of escapement device 56.

Once fuse 12 is armed, target impact will cause firing pin 40 to initiate the explosive train and thereby set off warhead 14. That is, after launch-induced forces have caused the setback safety pin to retract to a disengaged position and the rotor lock to disengage, thereby allowing stab detonator 52 to rotate with rotor weight 45 to the "in-line", armed position, projectile impact normally will cause forward translation of rotor 44 and stab detonator along axis 32, causing engagement of firing pin 40 with now in-line stab detonator 52. The initiation of stab detonator 52, in turn, activates booster charge 34 (see FIG. 1) which initiates shaped charge 14.

In accordance with the present invention, apparatus is included in the projectile for post-launch self-neutralization should the projectile not be fully armed or if impact does not initiate the fuze. Specifically, the apparatus includes an electric power source, an electric detonator, and a spin decay switch circuit operatively connected to both said power source and the electric detonator for initiating the electric detonator upon substantial decay of the projectile spin.

Figure 3A:
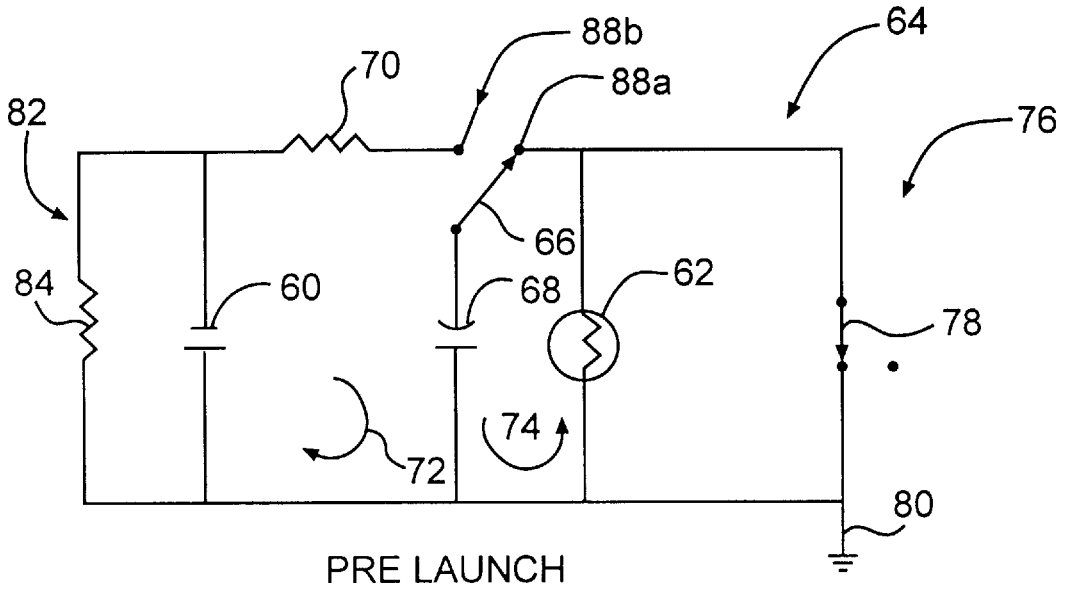
Figure 3B:
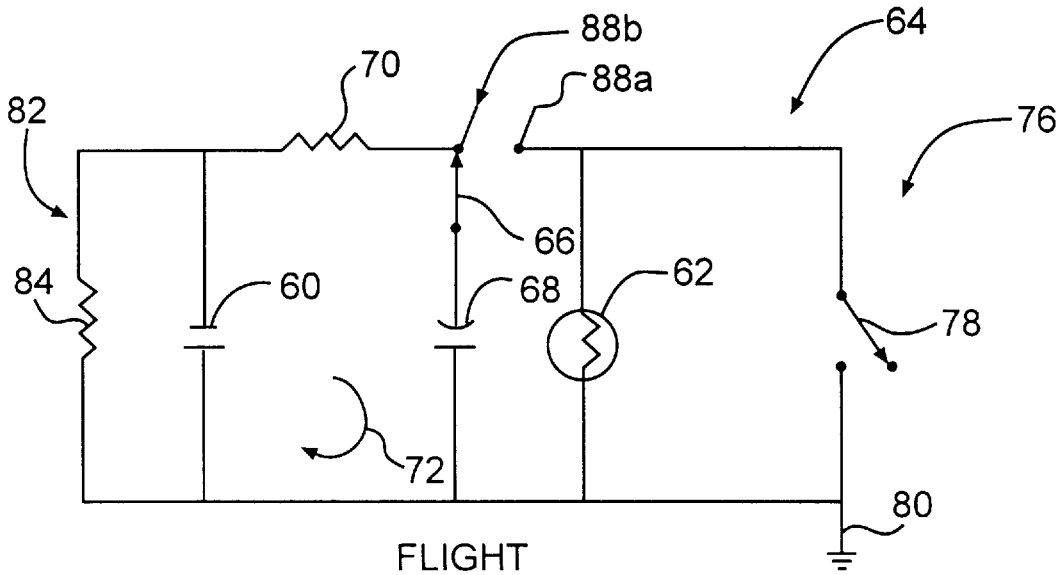
Figure 3C:
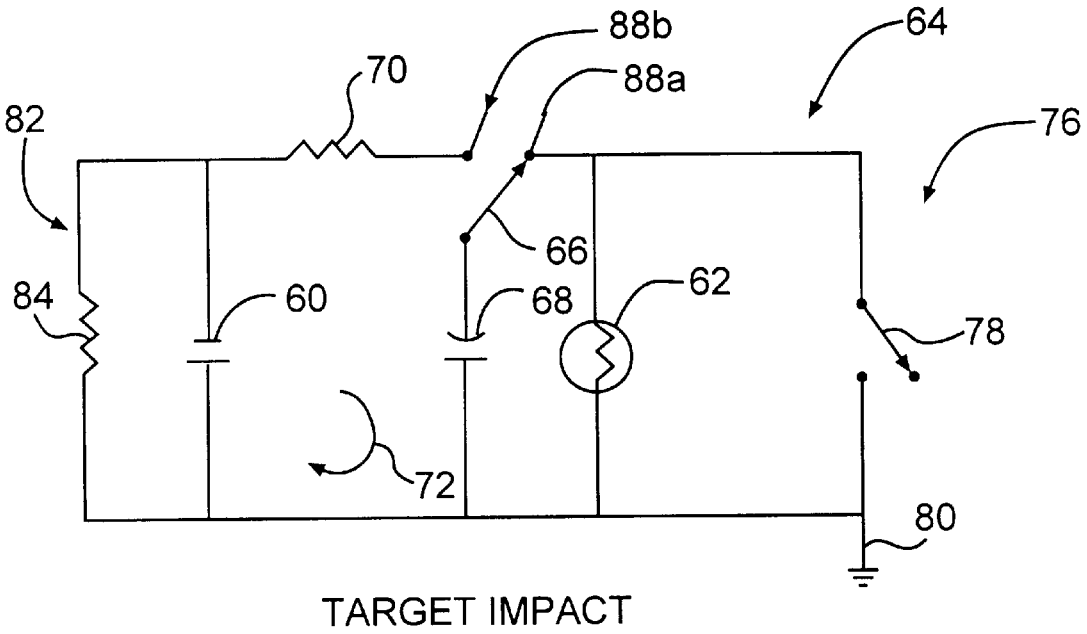

As embodied herein, and with references to FIGS. 3A–3C, the self-neutralization apparatus made in accordance with the present invention includes an electrical energy source 60, which in the present embodiment is a launch-activated 3.9 volt liquid reserve battery such as a KDI/Alliant Techsystems part #23910009-01 and an M100 type electric detonator 62 such as manufactured by Martin Electronics, Inc., Perry, Fla. The apparatus further includes spin decay switch circuit 64, including spin decay switch 66, and delay resistor 70. As can be appreciated from FIGS. 3A–3C, these components can be electrically interconnected into either a capacitor charging circuit loop 72 or capacitor discharge circuit loop 74, depending upon the status of spin decay switch 66.

Specifically, spin decay switch 66 has two positions depending upon the presence or absence of launch-induced spin forces. In FIG. 3B, post-launch, pre-impact configuration, the spin forces cause spin decay switch 66 to assume a first position which allows charging of energy storage capacitor 68 from battery 60 through delay resistor 70. In FIG. 3C, corresponding to target impact and substantial decay of spin, and thus in the spin-induced forces, spin decay switch 66 assumes a second position which closes the discharge circuit loop 74, while opening charging circuit loop 72. This allows energy storage capacitor 68 to discharge through electric detonator 62 via common ground 80. In FIG. 3A, spin switch decay switch also is in the second position, but at pre-launch times storage capacitor 68 is uncharged and shorting circuit 76 is activated thereby precluding initiators of detonator 62, as will be discussed henceforth.

In the depicted embodiment, delay resistor 70 is about 2.6 kΩ and an provides approximately 200 millisecond delay from battery activation to a fully charged state for energy storage capacitor 68 which has a capacitance of about 33 μfd. The value of delay resistor 70 can, of course, be changed to increase or decrease the charging rate for energy storage capacitor 68 if desired for a particular application.

Figure 4A:
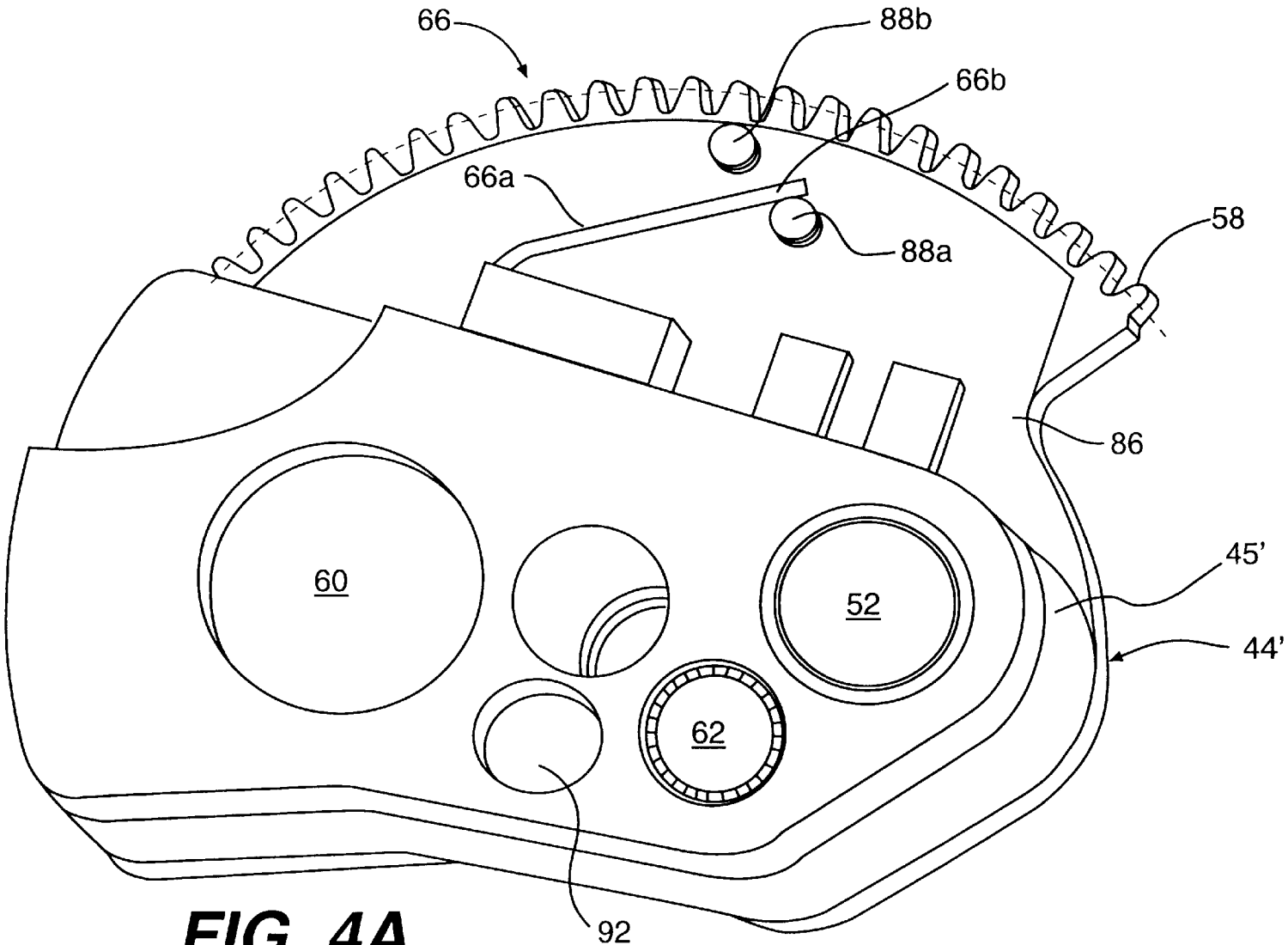
FIG. 4A and FIG. 4B depict the self-neutralization apparatus of FIGS. 3A–3C integrated with an M549 PIBD S&A device.

In accordance with the present invention, the self-neutralization apparatus configured for being carried by the projectile, such as projectile round 10, and in the first preferred embodiment is advantageously integrated with the existing S&A device 38. FIG. 4A shows a modified S&A device for the M549 PIBD fuse designated 38' including rotor 44' modified as described hereinafter. In particular, rotor 44' also includes an "out-of-balance" rotor weight 45' in which electric detonator 62 is mounted adjacent stab detonator 52. It will be appreciated that electric detonator 62 is mounted sufficiently close to stab detonator 52 is such that upon initiation of the electric detonator such as by operation of the spin decay switch circuit 64, stab detonator 52 will be initiated also. As seen in FIG. 4A, printed circuit board 86 on which the components of spin decay switch circuit 64 are mounted is captured between rotor weight 45' and sector gear 58' to make up the modified rotor 44'.

Figure 4B:
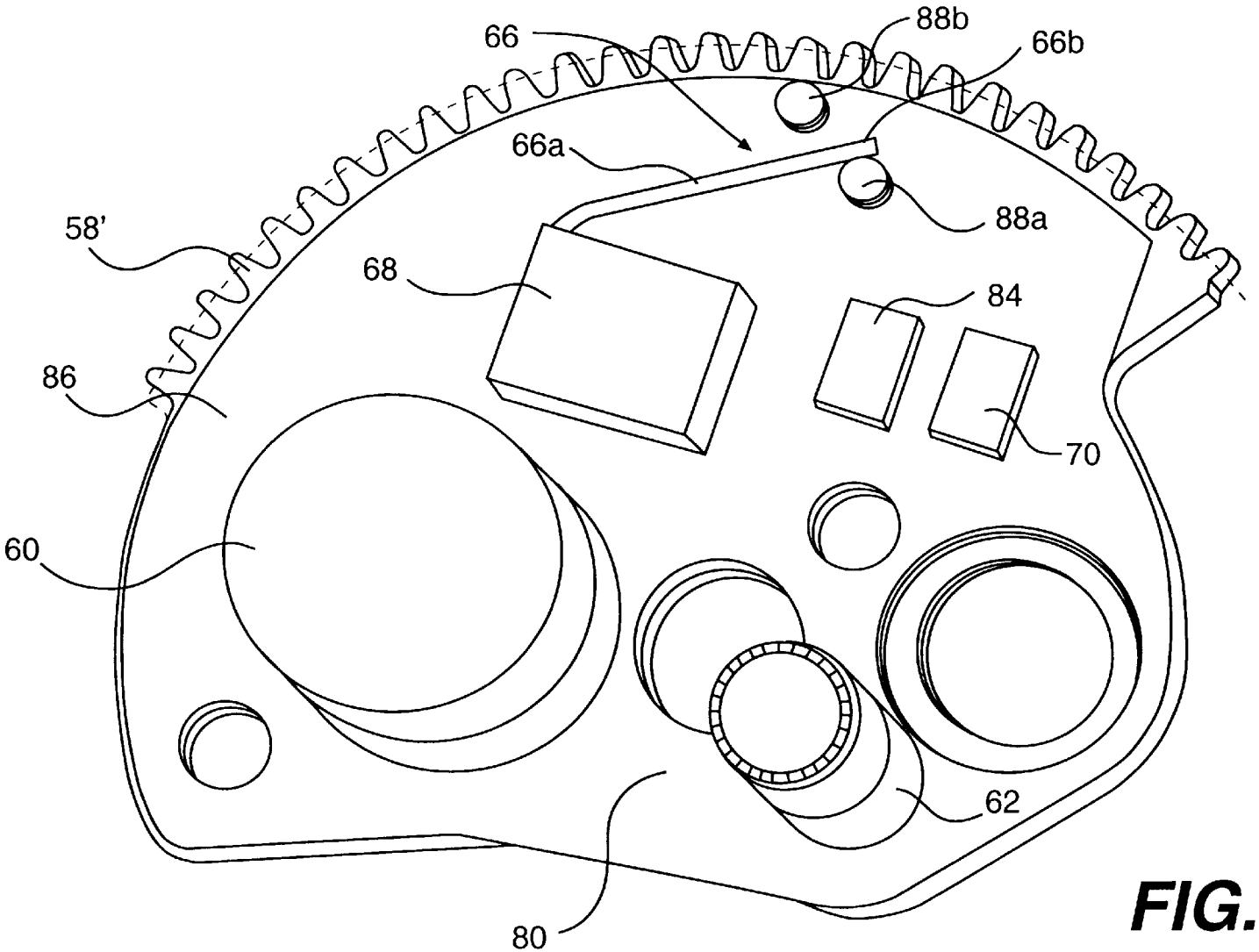

As best seen in FIG. 4B, which depicts rotor 44' with rotor weight 45' removed, printed circuit board 86 mounts battery 60, electric detonator 62, spin decay switch 66 and energy storage capacitor 68, electrically interconnected as depicted in FIGS. 3A–3C. Spin decay switch 66 is formed by cantilevered spring element 66*a* having free end 66*b* movable between electric contacts 88*a* and 88*b* depending upon the absence or presence of spin forces. That is, FIG. 4A shows switch 66 in the "no-spin" condition where free end 66*b* is biased against contact 88*a*, thereby closing the capacitor discharge loop 74 as is depicted in FIGS. 3A and 3B. Under launch-induced spin conditions, centrifugal force moves free end 66*b* outward to engage contact 88*b* which opens the discharge circuit loop 74 and closes the charging circuit loop 72, as is shown in FIG. 3B.

While the present embodiment of the self-neutralization apparatus as depicted in FIG. 3A is configured such that the energy storage capacitor discharge circuit loop 74 is closed during the pre-launch conditions, it is understood that energy storage capacitor is uncharged in this state such that no inadvertent initiation of electric detonator 62 should ordinarily occur. To provide further safety redundancy, the self-neutralization apparatus of the present invention includes shorting circuit 76 including shorting circuit switch 78 for electrically shorting electric detonator 62 to common ground 80 during prelaunch times. As can be appreciated from the schematics in FIGS. 3A–3C, shorting circuit switch 78 is permanently opened such as by launch-induced setback forces such that shorting circuit 76 is not reestablished upon target impact. A suitable device for shorting circuit switch 78, as depicted in FIGS. 4A and 4B, includes a frangible conductive lead 90 formed on printed circuit board 86 (depicted in FIG. 4B) in the path of setback weight 92 (shown in FIG. 4A) configured to be axially movable in response to setback forces along the projectile axis 32. Weight 92, which is slidably mounted in rotor weight 45' has a tapered leading edge (not shown) used to provide better cutting and is insulated to prevent reestablishment of the electrical path through setback weight 92 itself.

With reference again to FIGS. 3A–3C, the self-neutralization apparatus of the present invention further includes power dissipation circuit 82 including bleed resistor 84 electrically connected in parallel with battery 60. Discharge circuit 82 will ensure complete dissipation of power in battery 60 at a reasonable time after activation, providing yet additional assurance that an electrical detonator not initiated by normal functioning of the spin decay switch circuit 64 would not be activated during post-impact handling which conceivably could cause some inadvertent connection between battery 60 and the electric detonator 62. FIG. 4B shows bleed resistor 84 mounted on printed circuit 86 which also contains the necessary conductive leads to provide the interconnections as shown in FIGS. 3A–3C.

In operation, and also in accordance with the present invention, the above-disclosed apparatus provides a method for post-launch self-neutralization of a projectile having a fused warhead including a stab detonator and a launch-induced spin. Specifically the method comprises the steps of providing in the projectile an electric power source, an electric power storage device, an electric detonator, including the substep of locating the electric detonator sufficiently close to the stab detonator to initiate the stab detonator upon initiation of the electric detonator. The method further includes the step of supplying power to the electric power storage device from the electric power source after launch, and the further step of applying power from the electric power storage device to the electric detonator upon substantial decay of the projectile spin to initiate the electric detonator. As embodied herein, prior to firing projectile 12, any residual charge on energy storage capacitor 68 will be discharged to common ground 80 through shorting circuit 76 provided by the setback force-initiated shorting switch 78, as shown in FIG. 3A. At projectile launch, shorting switch 78 will permanently open and the spin decay switch will be forced to the "full" spin position against contact 88*b* as a consequence of the launch-induced projectile spin, as shown in FIG. 3B. Also, at launch, battery 60 will energize, charging energy storage capacitor 68 though delay resistor 70. The spin decay switch circuit 64 remains in this state until the projectile round looses its spin due to target or ground impact. At this point, depicted in FIG. 3C, spin decay switch 66 returns to its relaxed state against the electrical contact 88*a* where it completes discharge loop 74 causing the energy stored in capacitor 68 to be discharged through electric detonator 62 causing it to be initiated. Because electric detonator is positioned in close proximity to stab detonator 52, stab detonator 52 will be initiated sympathetically.

FIGS. 6A–6B, and 7A–7E show a second embodiment of the self-neutralization apparatus of the present invention, namely a S&A device for an M550 PIBD fuse typically used in rifle-launch grenade rounds. Components having similar functions to the components in the first embodiment depicted in FIGS. 3A–3C and 4A and 4B, discussed above, are given identical reference numerals, but with a 100 prefix (1xx).

Figure 5A:
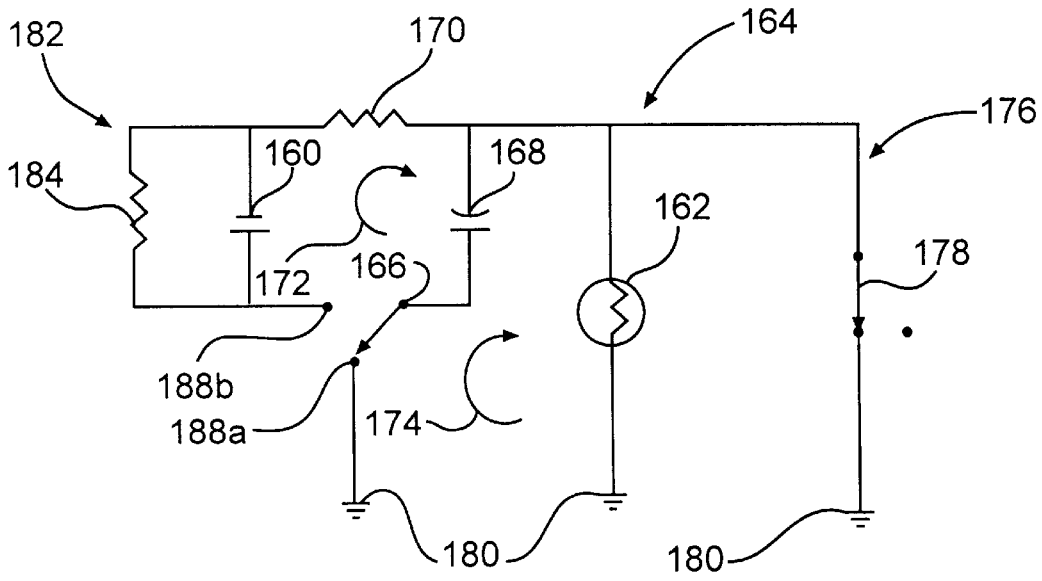
FIGS. 5A, 5B, and 5C schematically depict a second embodiment of a self-neutralizing apparatus made in accordance with the present invention where
Figure 5B:
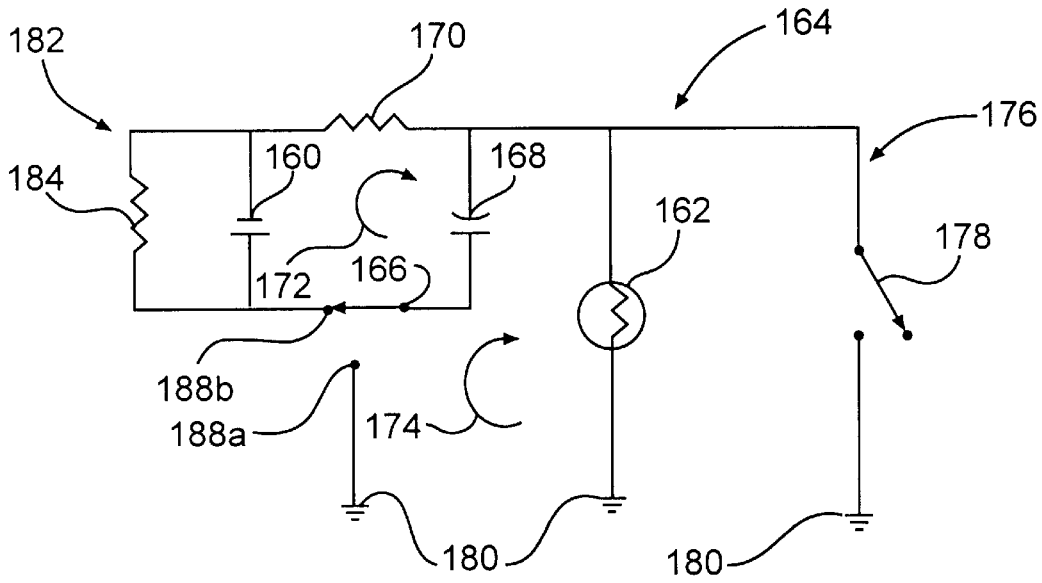
Figure 5C:
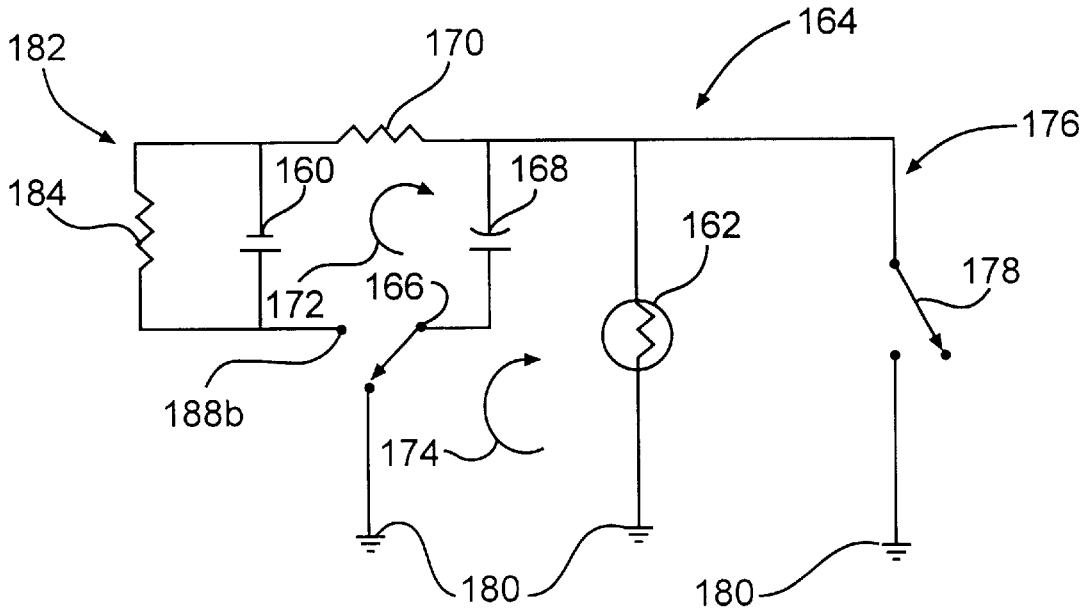

With initial reference to FIGS. 5A–5C, and with comparison to FIGS. 3A–3C in the previous embodiment, it is immediately apparent that the components of the self-neutralization apparatus of the second embodiments are virtually the same as the first, save for the placement of the spin decay switch 166. Specifically, FIGS. 5A–5C show the configuration of the self-neutralization apparatus at the pre-launch, flight, and target impact times respectively. The self-neutralization apparatus includes a launch-initiated liquid reserve battery 160, electric detonator 162, energy storage capacitor 168, and delay resistor 170 all electrically interconnected in spin decay circuit 164 by spin decay switch 166 to provide at appropriate times either capacitor charging circuit loop 172 or capacitor discharge circuit loop 174, as explained previously.

In the second embodiment, spin decay switch 166 is positioned between energy storage capacitor 168 and ground 180 in the discharge circuit loop 174 and between the energy storage capacitor 168 and battery 160, in charging circuit loop 172. In the previous embodiment the spin decay switch was positioned between the capacitor and electric detonator 162 and the discharge circuit loop and between the capacitor and the delay resistor in the capacitor charging loop. (See FIGS. 3A–3C). This difference is clue to the different physical placements of the componeents in the respective fuze applications. Also included in the self-neutralization apparatus shown in FIGS. 5A–5C is electric detonator shorting circuit 176 having shorting circuit switch 178 to provide short circuiting of electric detonator 162 at prelaunch times and a battery powered dissipation circuit 182 including bleed resistor 184 to provide electrical dissipation of the remaining battery power at times after target impact.

Figure 6A:
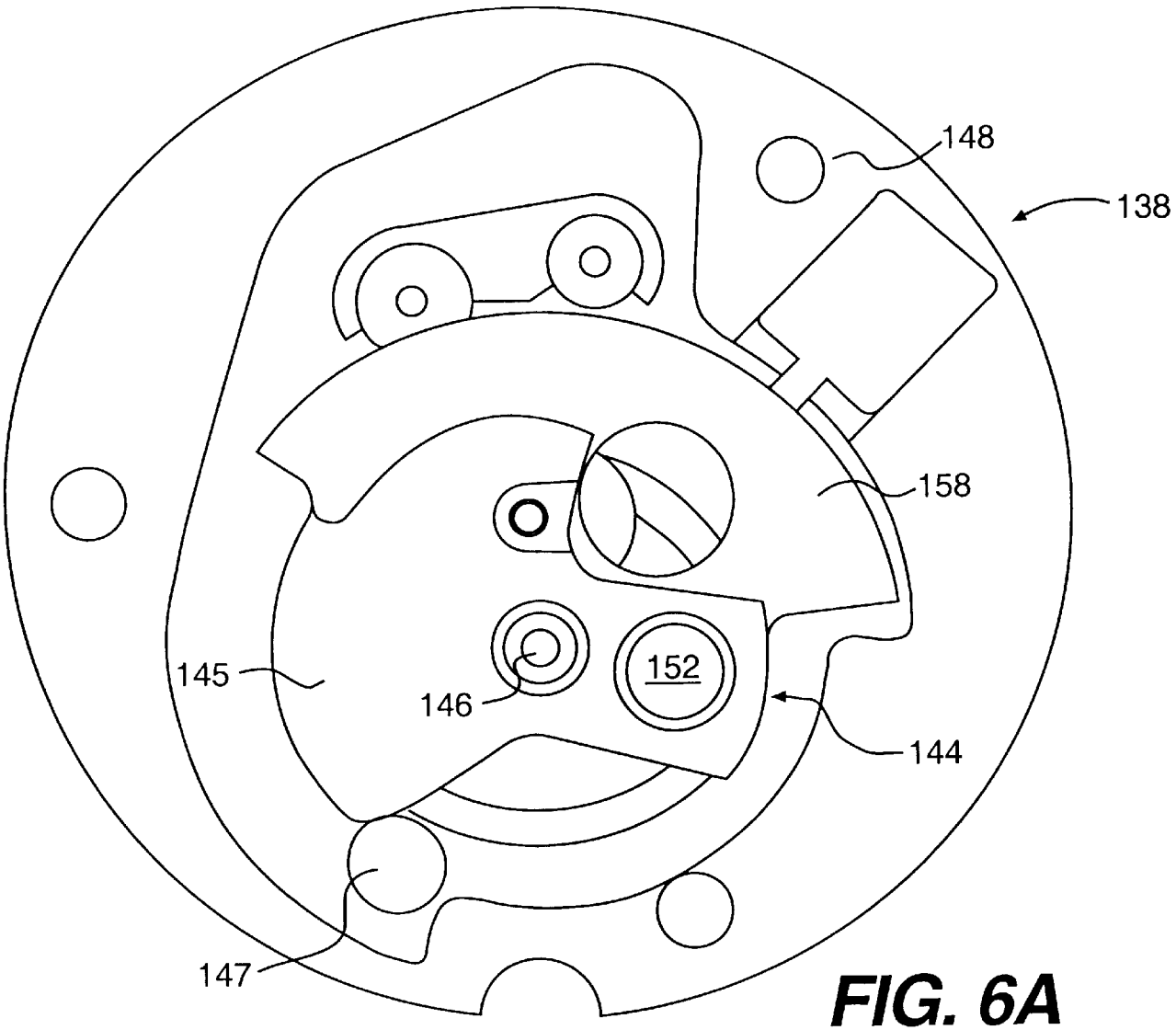
FIGS. 6A and 6B present schematic representation of a standard M550 S&A device in the "safe" position and the "armed" position.
Figure 6B:
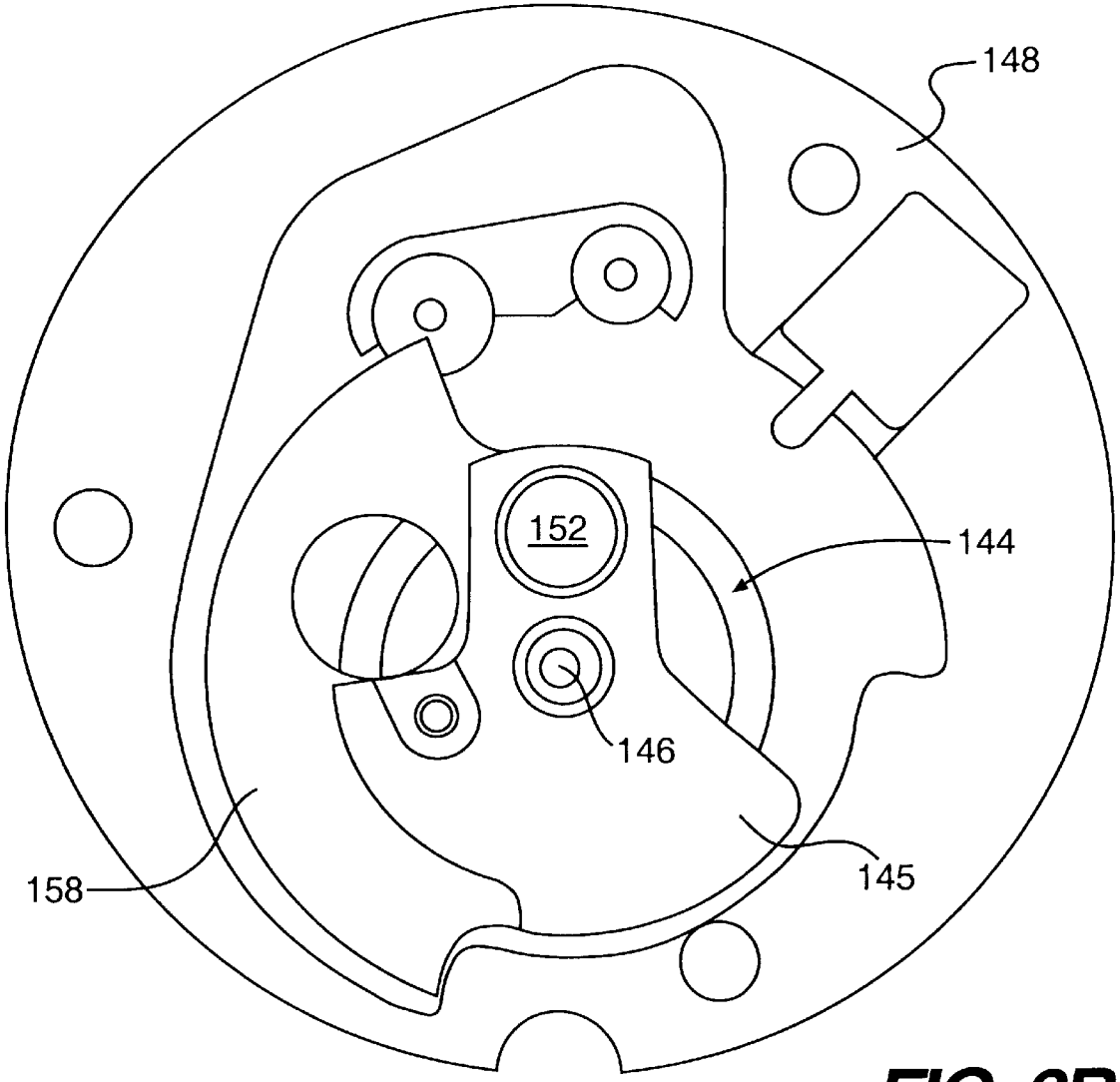

The major differences between the second embodiment and the first reside in the constructional details of integrating the self-neutralization apparatus with the S&A device for the M550 PIBD fuse. With initial reference to FIGS. 6A and 6B, there is shown a standard, that is unmodified, M550S&A device 138 including rotor 144 which is an assembly of an out-of-balance rotor weight 145 and sector gear 158 pivotally mounted to housing 148 via pivot pin 146. Mounted in the rotor weight 145 element is stab detonator 152 which is an M55-type. As one skilled in the art would understand from the previous discussion, and comparing FIGS. 6A which depict the prelaunch "safe" position of the S&A device 138, and 6B the post-launch "armed" position, the launch-induced spin forces acting on the out-of-balance rotor weight 145 cause the rotor 144 to pivot about 146 bringing stab detonator 152 into alignment with a firing pin (not shown) and the explosive train leading to the shaped charge (also not shown). Also shown in FIGS. 6A and 6B is set back safety pin 147 slidably mounted in housing 148 and positioned to engage rotor weight 145 at times prior to launch. Upon launch, set back safety pin 147 moves axially, freeing rotor weight 145 and thus rotor 144 to pivot in response to the launch-induced spin forces, as would be understood.

Figure 7A:
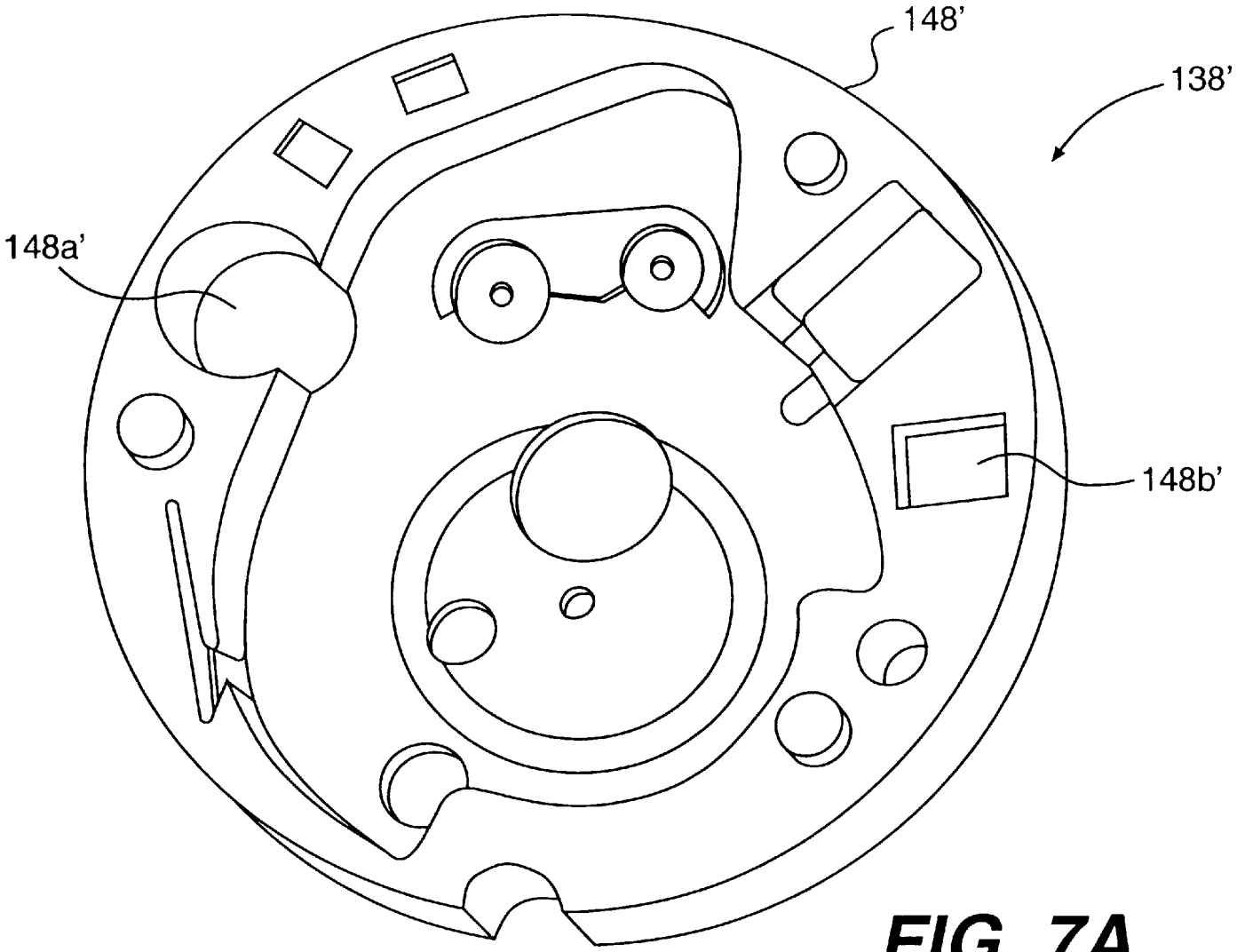
FIGS. 7A–7E depict an M550 S&A device modified to integrate the self-neutralization apparatus depicted in FIGS. 5A–5C.
Figure 7B:
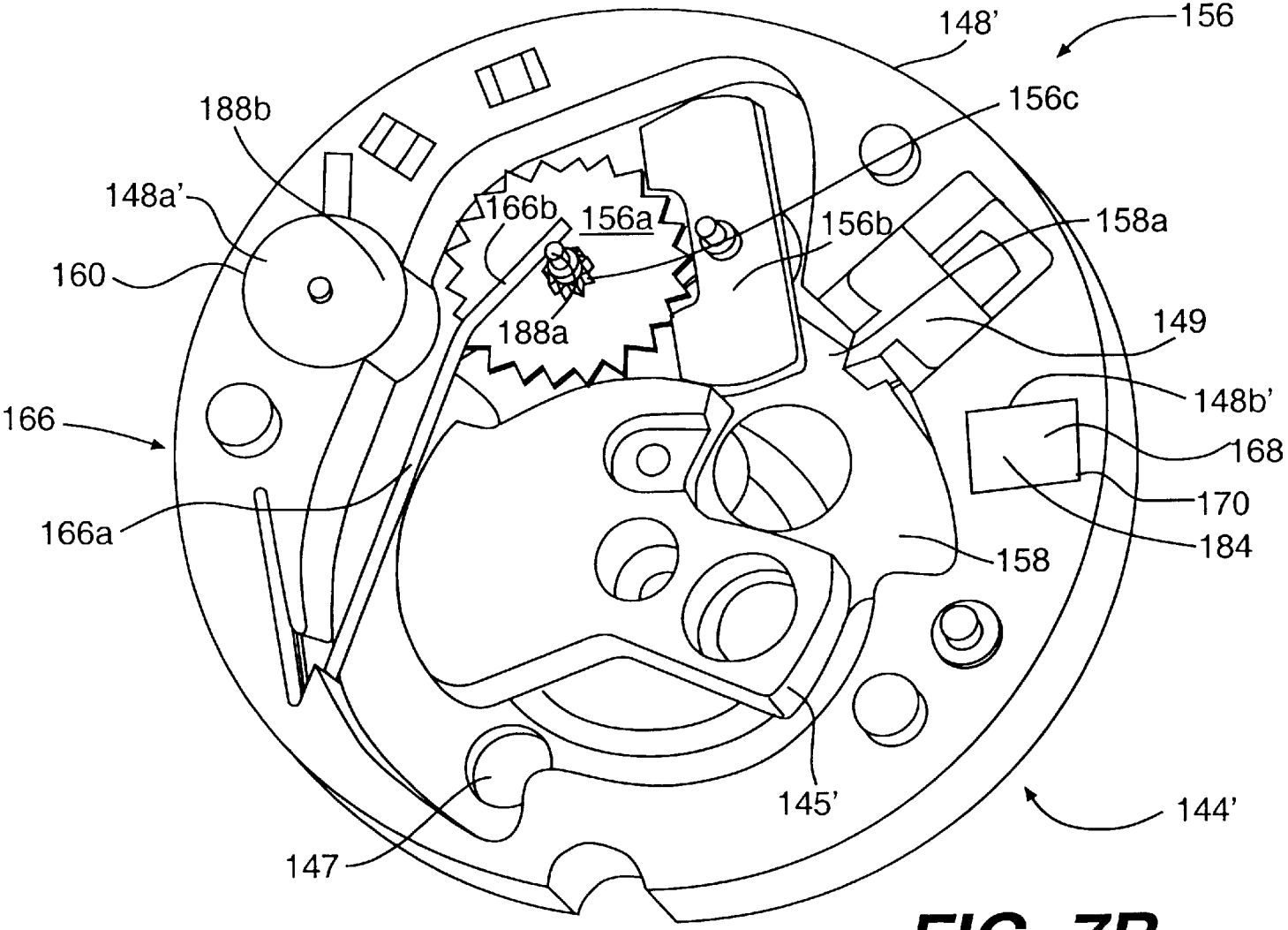
Figure 7C:
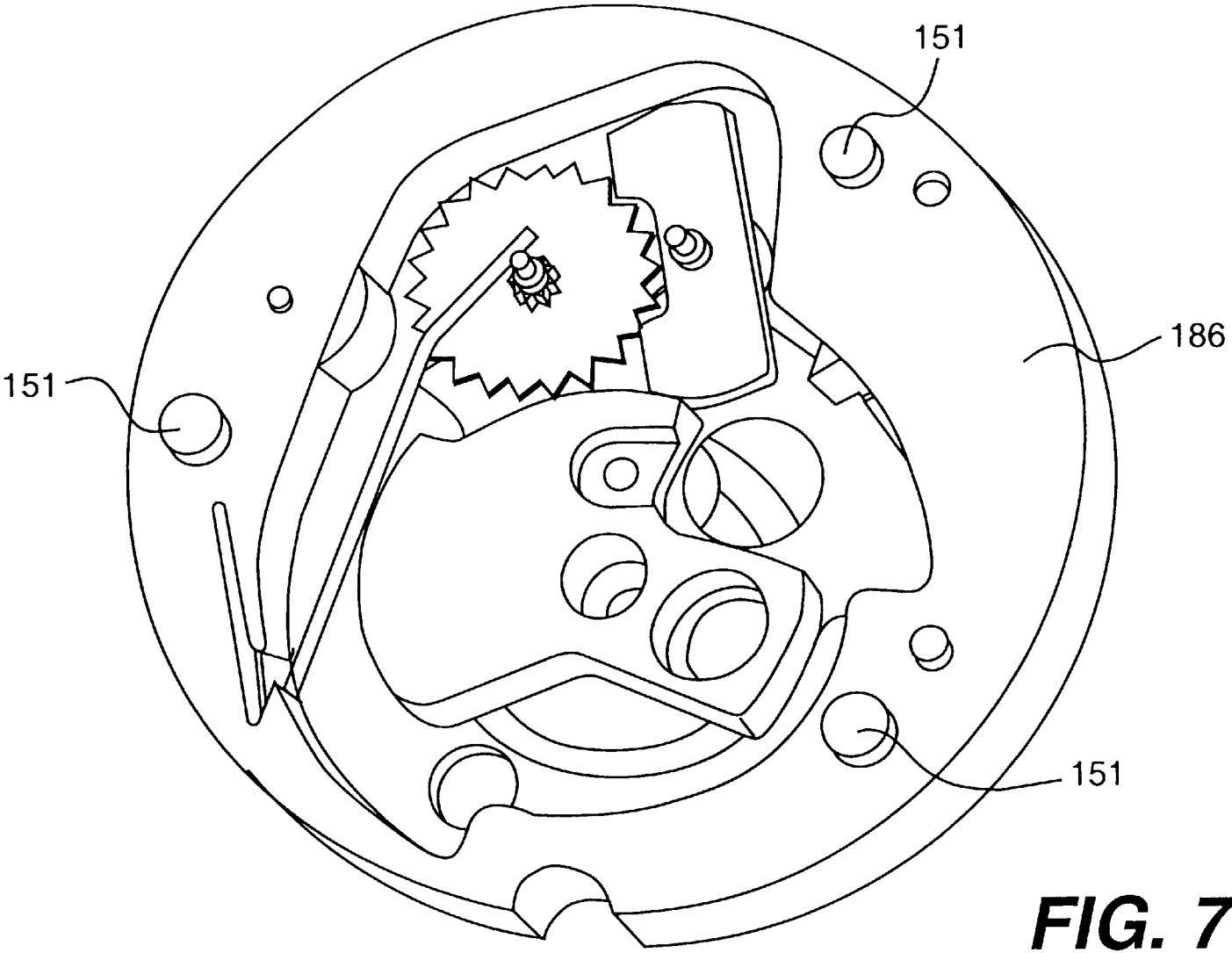

Turning now to FIGS. 7A–7E which show exploded views of a modified S&A device designated 138' incorporating components of the self-neutralization apparatus depicted schematically in FIGS. 5A–5C. Specifically, FIG. 7A shows housing 148' which is formed from plastic and includes preformed cavities 148*a*' and 148*b*' for accepting battery 160 and the balance of the electrical components, respectively. As shown in FIG. 7C, printed circuit board 186 on which are mounted the various electrical components of the self-neutralization apparatus is attached to housing 148' via stakes 151. As best seen in FIG. 7B where printed circuit board 186 has been removed for illustration, battery 160 and the electrical components, namely energy storage capacitor 168, delay resistor 170 and bleed resistor 184 are located in the appropriate preformed spaces 148*a*' and 148*b*' as identified previously. Also shown in FIG. 7B are set back weight 147 mounted in housing 148' and escapement device 156 including star wheel 156*a* and the pivot pawl 156*b* which together provide a controlled rate of rotation of rotor 144' through engagement with sector gear 158', as would be understood by one skilled in the art. Also shown in FIG. 7B is spin safety switch 149 which engages slot 158*a* in sector gear 158 and is radially movable by the launch-induced spin forces to allow rotation of rotor 144.

FIG. 7B also shows details of spin decay switch 166. Specifically, as in the previous embodiment, spin decay switch 166 includes a cantilevered spring wire 166*a* having a free end 166*b* biased against contact 188*a* but movable to contact 188*b* in the presence of spin induced forces. Electric contact 188*b* is a conductive portion of the battery 160 while electric contact 188*a* is a portion of star wheel shaft 156*c* which is connected to ground 180 via appropriate conductive leads in printed circuit board 186 (See FIG. 7C). As would be clear to one skilled in the art, the position of spin decay switch 166 shown in 7B is the "non spin" state where the electrical engagement of spring wire 166*a* to contact 188*a* on star wheel shaft 156*c* closes capacitor discharge circuit 174. Under launch-induced spin forces movement and subsequent contact between free end 166*b* of spring wire 166*a* and contact 188*b* would open discharge circuit loop 174 and close charging circuit loop 172. Subsequent to target impact or other substantial decay of projectile spin, free end 166*b* of spring wire 166*a* returns to engage contact 188*a* as a consequence of the spring bias, thereby opening charging circuit loop 172 and closing discharge circuit loop 174 allowing energy storage capacitor 168 to discharge through and initiate electric detonator 162.

Figure 7D:
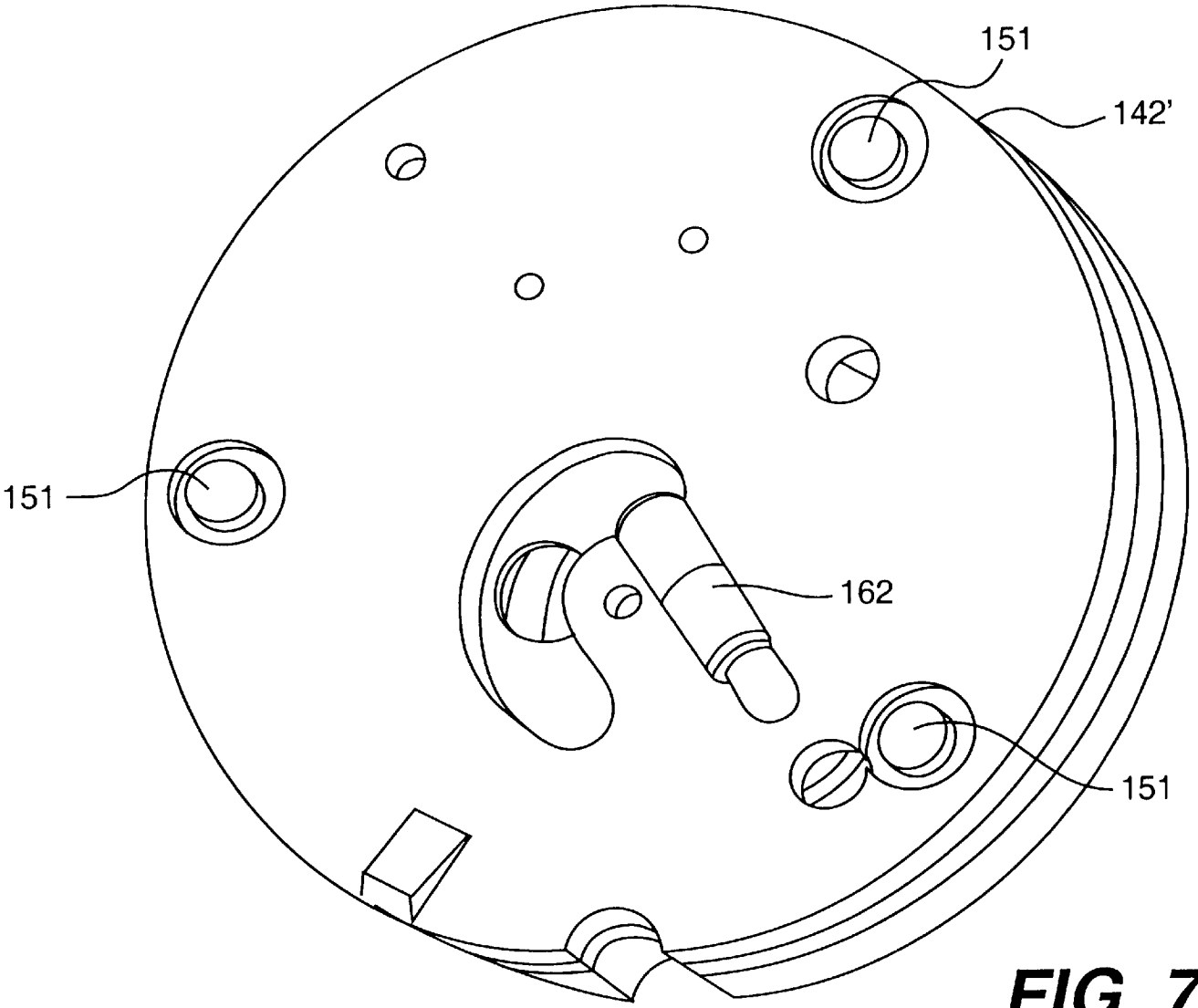
Figure 7E:
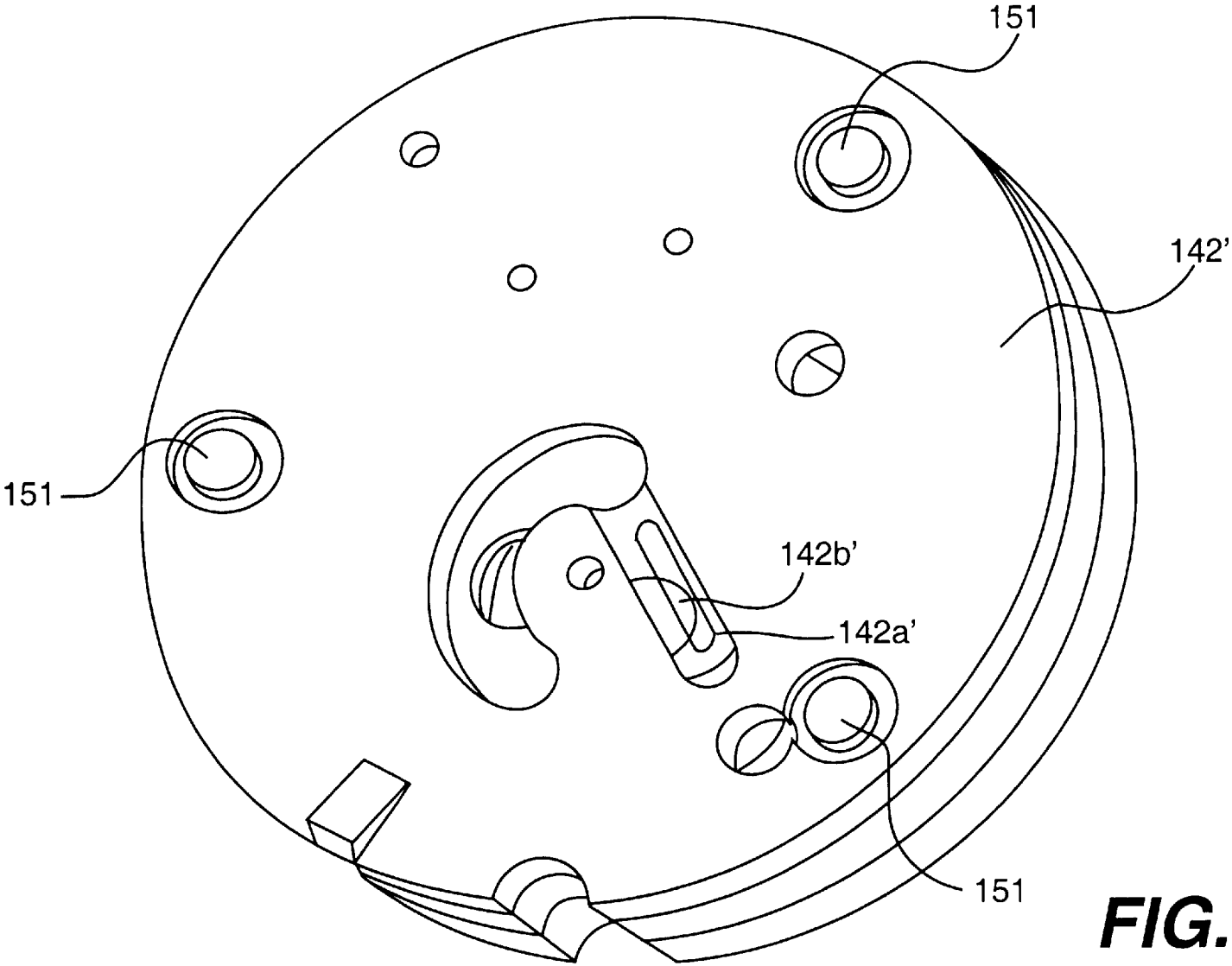

FIGS. 7D and 7E show additional features of modified S&A device 138'. Specifically, the figures show top plate 142' with and without the electric detonator 162. Top plate 142' also is attached to housing 148' via stakes 151 capturing printed circuit board 186 therebetween as would be understood. In addition to preformed cavity 142*a*' in which electric detonator is mounted, top plate 142' has through hole 142*b*' interconnecting cavity 142*a*' with the interior of housing 148' in the proximity of stab detonator 152 when rotor 144' is in the rest position, thereby insuring close proximity of electric detonator 162 and stab detonator 152 such that initiation of the former will provide sympathetic initiation of the latter.

It will be apparent to those skilled in the art that various modifications and variations can be made in the above-described embodiments of the present invention without departing from the scope or spirit of the invention. Thus, it is intended that the present invention cover such modifications and variations provided they come within the scope of the appended claims and their equivalents.

What is claimed:

1. Apparatus for post-launch self-neutralization of a projectile having a fused warhead including a stab detonator and a launch-induced spin, said apparatus comprising:

an electric power source;

an electric detonator positioned sufficiently close to the stab detonator to initiate the stab detonator upon initiation of said electric detonator; and a spin decay switch circuit operatively connected to both said power source and said electric detonator for immediately initiating said electric detonator upon substantial decay of the projectile spin, each of said power source, said spin decay switch circuit, and said electric detonator being configured for mounting in the projectile.

2. The apparatus of claim 1 wherein the spin decay switch circuit includes an energy storage capacitor, and a spin decay switch having a first position under the influence of launch-induced spin forces, and a second position under the substantial absence of launch-induced spin forces, said spin decay switch in said first position interconnecting said energy storage capacitor to be charged by said power source, and in said second position interconnecting said energy storage capacitor to be discharged through said electric detonator.

3. The apparatus of claim 2 wherein said spin decay switch circuit has a ground and is configured for discharging said energy storage capacitor to said ground through said electric detonator.

4. The apparatus as in claim 2 wherein said spin decay switch includes a cantilevered spring contact element having a free end movable between said first and second positions.

5. The apparatus as in claim 1 wherein said electric power source includes a launch-activated reserve battery.

6. The apparatus as in claim 1 further including a shorting circuit electrically connected in parallel with said electric detonator, said electric detonator shorting circuit being activated from a conducting state for times prior to launch, to a non-conducting state for times following launch.

7. The apparatus of claim 6 wherein said spin decay switch circuit has a ground and is configured for discharging said energy storage capacitor to said ground through said shorting circuit for pre-launch, zero-spin times.

8. The apparatus as in claim 6 wherein said electric detonator shorting circuit includes a launch-induced setback force-activated switch.

9. The apparatus as in claim 8 wherein the setback-force activated switch includes a conducting element and a movable weight element disposed to shear said conducting element when acted upon by launch-induced setback forces.

10. The apparatus of claim 1 wherein the projectile also has a spin-activated safing and arming mechanism including a housing and a rotor pivotally mounted therein, the stab detonator being mounted on the rotor, each of said electric power source and said spin decay switch circuit being configured for mounting on one of the rotor and the housing.

11. A safing and arming mechanism having the apparatus of claim 10.

12. A projectile having the apparatus of claim 10.

13. A projectile having the apparatus of claim 1.

14. The apparatus as in claim 1 further including a power source dissipation circuit including a bleed resistor electrically connected in parallel with said power source circuit.

15. A method for post-launch self-neutralizing a projectile having a fused warhead including a stab detonator and a launch-induced spin, the method comprising the steps of:

a. providing in the projectile an electric power source, an electric power storage device, and an electric detonator, the providing step including the substep of locating the electric detonator sufficiently close to the stab detonator to initiate the stab detonator upon the initiation of the electric detonator;

b. supplying power to the electric power storage device from the electric power source after launch; and c. applying power from the electric power storage device to the electric detonator immediately upon substantial decay of the projectile spin to initiate the electric detonator.

16. The method as in claim 15 including the initial step of providing an energy storage capacitor, the applying power step further includes the substeps of operatively interconnecting the electric power source to charge the energy storage capacitor using launch-induced spin forces, and subsequently operatively interconnecting the charged energy storage capacitor to discharge through the electric detonator after substantial decay of the launch-induced spin forces.

17. The method of claim 15 wherein the step of activating the electric power source is accomplished using launch-induced setback forces.

18. The method of claim 15 further including the steps of providing a shorting circuit for the electric detonator for times prior to launch and deactivating the shorting circuit for times subsequent to launch.

19. The method of claim 18 wherein the step of deactivating the electric detonator shorting circuit is accomplished using launch-induced setback forces.

20. The method of claim 15 further including the step of deactivating the electric power source a predetermined time after activation.

21. The method of claim 20 wherein the deactivating step includes dissipating the power in the electric power source.

22. A fuzing apparatus for post-launch self-neutralization of a projectile having a launch-induced spin, said apparatus comprising:

a stab detonator operable to detonate the projectile;

an electric power source;

an electric detonator positioned sufficiently close to the stab detonator to initiate the stab detonator upon initiation of said electric detonator; and a spin decay switch circuit operatively connected to both said power source and said electric detonator for immediately initiating said electric detonator upon substantial decay of the projectile spin, each of said power source, said spin decay switch circuit, and said electric detonator being configured for mounting in the projectile.

23. The fuzing apparatus of claim 22 wherein the spin decay switch circuit includes an energy storage capacitor, and a spin decay switch having a first position under the influence of launch-induced spin forces and a second position under the substantial absence of launch-induced spin forces, said spin decay switch in said first position interconnecting said energy storage capacitor to be charged by said power source, and in said second position interconnecting said energy storage capacitor to be discharged through said electric detonator.

24. The fuzing apparatus as in claim 23 wherein said spin decay switch includes a cantilevered spring contact element having a free end movable between said first and second positions.

25. The fuzing apparatus as in claim 22 wherein said electric power source includes a launch-activated reserve battery.

26. The fuzing apparatus as in claim 22 further including a shorting circuit electrically connected in parallel with said electric detonator, said electric detonator shorting circuit being activated from a conducting state for times prior to launch, to a non-conducting state for times following launch.

27. The fuzing apparatus as in claim 26 wherein said shorting circuit includes a launch-induced setback force-activated switch.

28. The fuzing apparatus as in claim 27 wherein the setback-force activated switch includes a conducting element and a movable weight element disposed to shear said conducting element when acted upon by launch-induced setback forces.

29. The fuzing apparatus as in claim 22 wherein the projectile also has a spin-activated safing and arming mechanism including a housing and a rotor pivotally mounted therein, the stab detonator being mounted on the rotor, each of said electric power source and said spin decay switch circuit being configured for mounting on one of the rotor and the housing.

* * * * *